US008372224B2

(12) United States Patent
Dave et al.

(10) Patent No.: US 8,372,224 B2
(45) Date of Patent: Feb. 12, 2013

(54) STRUCTURALLY SOUND REACTIVE MATERIALS

(75) Inventors: Vivek R Dave, Los Alamos, NM (US); Mark J Cola, Santa Fe, NM (US); Robert E Swanson, Albuquerque, NM (US); Daniel Hartman, Santa Fe, NM (US)

(73) Assignee: B6 Sigma, Inc., Santa Fe, NM (US)

( * ) Notice: Subject to any disclaimer, the term of this patent is extended or adjusted under 35 U.S.C. 154(b) by 217 days.

(21) Appl. No.: 12/722,537

(22) Filed: Mar. 12, 2010

(65) Prior Publication Data

US 2010/0229751 A1 Sep. 16, 2010

Related U.S. Application Data

(60) Provisional application No. 61/159,500, filed on Mar. 12, 2009.

(51) Int. Cl.

| | |
|---|---|
| ***C06B 45/00*** | (2006.01) |
| ***C06B 45/12*** | (2006.01) |
| ***C06B 45/04*** | (2006.01) |
| ***D03D 23/00*** | (2006.01) |
| ***D03D 43/00*** | (2006.01) |

(52) U.S. Cl. ..... 149/109.6; 149/2; 149/14; 149/17; 149/109.4

(58) Field of Classification Search ..... 149/109.6, 149/2, 14, 17, 109.4
See application file for complete search history.

(56) References Cited

U.S. PATENT DOCUMENTS

| | | | | |
|---|---|---|---|---|
| 3,608,490 | A * | 9/1971 | O'Keefe | 89/1.14 |
| 5,789,697 | A * | 8/1998 | Engelke et al. | 102/202.5 |
| 6,151,198 | A * | 11/2000 | Prater et al. | 360/265.7 |
| 7,597,046 | B1 * | 10/2009 | Laib | 102/202.5 |
| 8,006,621 | B1 * | 8/2011 | Cherry | 102/476 |
| 2007/0163460 | A1 * | 7/2007 | Dave et al. | 102/517 |

* cited by examiner

*Primary Examiner* — James McDonough
(74) *Attorney, Agent, or Firm* — V. Gerald Grafe

(57) ABSTRACT

The present inventions provide methods of manufacturing methods for case metallic materials for munitions that have high enthalpic energy release and controlled fragmentation and breakup enabling fragment speeds up to twice what is otherwise possible in explosively driven metal systems, and munitions made by such methods. Embodiments of the invention involve the thixotropic processing of energetic materials such as aluminum together with high density materials such as tantalum or tungsten to achieve material microstructures with a bulk density equivalent to steel, but with the energy release potential of materials such as finely dispersed aluminum powders. Such methods of mixing and blending of high energy and high density materials can provide a microstructure that has large density and shock impedance differences over length scales of 10-100 microns, resulting in enhanced materials fragmentation in the shock or brisant loading regime, incipient melting at the lower melting point constituents, and additional enhancement of fragmentation in the gas-dynamic expansion phase of munitions breakup. Additionally, the present inventions provide a range of surface and near-surface processing methods to enhance spall and ejecta from conventional munitions systems, enhancing munition breakup and reactivity as well.

7 Claims, 4 Drawing Sheets

STRUCTURALLY SOUND REACTIVE MATERIALS

CROSS REFERENCE TO RELATED APPLICATIONS

This application claims priority to U.S. provisional application 61/159,500, filed Mar. 12, 2009, which is incorporated herein by reference.

TECHNICAL FIELD

The present inventions relate to the field of material processing, and more specifically to semi-solid metal processing. The present inventions also relate to munitions, and more specifically to munitions with reactive materials incorporated into the munitions and with high enthalpic energy release and controlled fragmentation and breakup.

BACKGROUND

Semi-solid Metal Processing

The present invention is compatible with semi-solid metal processing, also known as semi-solid metal casting. Semi-solid metal casting (SSM), also known as thixocasting, rheocasting, thixoforming or thixomolding, is a near net shape process in the production of parts out of non-ferrous metals, such as aluminium, copper, or magnesium. The process combines the advantages of casting and forging. The process is named after the fluid property thixotropy, Which is the phenomenon that allows this process to work. Simply, thixotropic fluids shear when the material flows, but thicken when standing. The potential for this type of process was first recognized in the early 1970s. See, e.g., Young, Kenneth P., Semi-Solid Metal Casting: Reducing the Cost of Copper Alloy Parts, Massachusetts Office of Technical Assistance, http://web.archive.org/web/20061007163908/http://www.mass.gov/envir/ota/publications/pdf/semi solid metal fact sheet.pdf; Lowe, Anthony; Ridgway, Keith; Atkinson, Helen (September 1999), "Thixoforming", Materials World 7 (9): 541-543, http://www.azom.com/details.asp?ArticleID=1373; each of the preceding is incorporated by reference herein.

SSM is typically done at a temperature that puts the metal between its liquidus and solidus temperature. Generally the metal is 30 to 65% solid. The metal can have a low viscosity, and to reach this low viscosity the material can have a globular primary surrounded by the liquid phase. The temperature range possible depends on the material and for aluminum alloys is 5-10° C., but for narrow melting range copper alloys it can be only several tenths of a degree.

Semi-solid casting is typically used for high-end castings. For aluminum alloys typical parts include engine suspension mounts, air manifold sensor harness, engine blocks and oil pump filter housing. Kapranos, Proc. 10th Inter. Conf. Semi-Solid Processing of Alloys and Composites, Aachen, Germany & Liege, Belgium, 2008. For magnesium alloys, semi-solid casting is typically used to produce extremely thin walled castings, such as computer and camera bodies.

There are a number of different techniques to produce semi-solid castings. For aluminum alloys some common processes include thixocasting and rheocasting. Stephen P. Midson, Rheocasting Processes for Semi-Solid Casting of Aluminum Alloys, Die Casting Engineer, January 2006, incorporated herein by reference. Other process such as strain induced melt activation (SIMA) and RAP can also be used with aluminum alloys, although are less common commercially. With magnesium alloys, a common process is thixomolding. S. LeBeau & R Decker, "Microstructural Design of Thixomolded Magnesium Alloys", Proc. 5th Inter. Conf. Semi-Solid Processing of Alloys and Composites, Golden, Colo., 1998, incorporated herein by reference.

Thixocasting utilizes a pre-cast billet with a non-dendritic microstructure that is normally produced by vigorously stirring the melt as the bar is being cast. Induction heating is normally used to re-heat the billets to the semi-solid temperature range, and die casting machines are used to inject the semi-solid material into hardened steels dies. Thixocasting is being performed commercially in North America, Europe and Asia. Thixocasting has the ability to produce extremely high quality components due to the product consistency that results from using pre-cast billet that is manufactured under the same ideal continuous processing conditions that are employed to make forging or rolling stock. Stephen P. Midson, Semi-Solid Casting of Aluminum Alloys: An Update, Die Casting Engineer, September 2008, incorporated herein by reference.

Rheocasting develops the semi-solid slurry directly from the liquid, normally adjacent to the die casting machine. There are a large number of rheocasting processes that have been proposed over the past 10 years or so, and they generally differ in the method used to generate the semi-solid slurry. 18 different rheocasting techniques were documented in a recent publication.

For magnesium alloys, thixomolding uses a machine similar to injection molding. In a single step process, room temperature magnesium alloy chips are fed into the back end of a heated barrel through a volumetric feeder. The barrel can be maintained under an argon atmosphere to prevent oxidation of the magnesium chips. A screw feeder located inside the barrel feeds the magnesium chips forward as they are heated into the semi-solid temperature range. The screw rotation provides the necessary shearing force to generate a globular structure suitable for semi-solid casting. Once enough slurry has accumulated, the screw moves forward to inject the slurry into a steel die. Stephen P. Midson, Robert K. Kilbert, Stephen E. Le Beau & Raymond Decker, "Guidelines for Producing Magnesium Thixomolded Semi-Solid Components used in Structural Applications", Proc. 8th Inter. Conf. Semi-Solid Processing of Alloys and Composites, Limasol, Cyprus, 2004, incorporated herein by reference.

In the SIMA method the material is first heated to the SMM temperature. As it nears the solidus temperature the grains recrystallize to form a fine grain structure. After the solidus temperature is passed the grain boundaries melt to form the SSM microstructure. For this method to work the material should be extruded or cold rolled in the half-hard tempered state. This method is generally limited in size to bar diameters smaller than 37 mm (1.5 in); because of this only smaller parts can be cast.

Reactive Munitions

The present inventions can be used to benefit reactive munitions. Generally, there is a desire to provide munitions with high enthalpic energy release and controlled fragmentation and breakup. There is also a desire to provide for high velocity fragment dispersion. The case must still provide the structural properties necessary to withstand the propulsion events. Previously, the case was required to be formed of a high strength material, for example steel, and reactive materials were housed within or coated onto the case. As examples, see U.S. patent publications 20040016355; 20040112241; 20060011086; 20060288897; 20080229963; each of which is incorporated herein by reference. The present inventions can provide more efficient incorporation of reactive materials in munitions. The present inventions can also provide for higher velocity fragment dispersal than was previously attainable.

Other Applications

There are several other applications for the present inventions. For example, embodiments of the present invention can be used in structural engineering applications where the thermal properties of aluminum are desired, but the mass properties of steel (e.g., density) are desired. Also, embodiments of the present inventions can be applied in sporting goods, as the composite materials enabled by the present inventions can have unique properties that can be desirable for sporting equipment such as some types of golf clubs.

SUMMARY OF THE INVENTION

The present inventions provide methods of manufacturing methods for case metallic materials for munitions that have high enthalpic energy release and controlled fragmentation and breakup enabling fragment speeds up to twice what is otherwise possible in explosively driven metal systems, and munitions made by such methods. Embodiments of the invention involve the thixotropic processing of energetic materials such as aluminum together with high density materials such as tantalum or tungsten to achieve material microstructures with a bulk density equivalent to steel, but with the energy release potential of materials such as finely dispersed aluminum powders. Such methods of mixing and blending of high energy and high density materials can provide a microstructure that has large density and shock impedance differences over length scales of 10-100 microns, resulting in enhanced materials fragmentation in the shock or brisant loading regime, incipient melting at the lower melting point constituents, and additional enhancement of fragmentation in the gas-dynamic expansion phase of munitions breakup. Additionally, the present inventions provide a range of surface and near-surface processing methods to enhance spall and ejecta from conventional munitions systems, enhancing munition breakup and reactivity as well.

DESCRIPTION OF THE INVENTION

Figure 1:
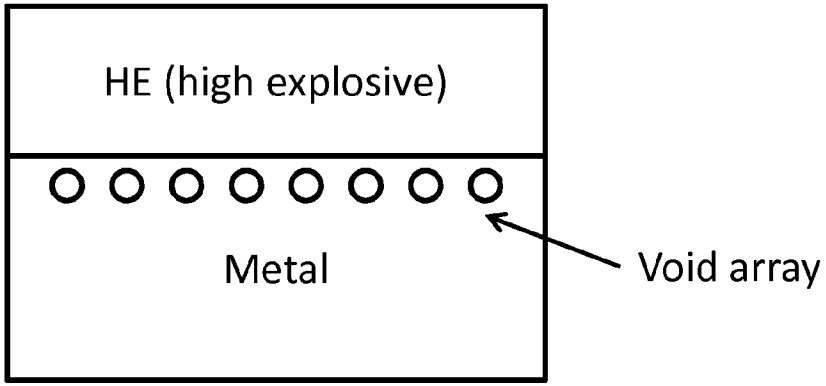
FIG. 1 is a schematic illustration of an example embodiment of the present invention having a patterned void array.

The present inventions provide methods of manufacturing methods for case metallic materials for munitions that have high enthalpic energy release and controlled fragmentation and breakup enabling fragment speeds up to twice what is otherwise possible in explosively driven metal systems, and munitions made by such methods. Embodiments of the invention involve the thixotropic processing of energetic materials such as aluminum together with high density materials such as tantalum or tungsten to achieve material microstructures with a bulk density equivalent to steel, but with the energy release potential of materials such as finely dispersed aluminum powders. Such methods of mixing and blending of high energy and high density materials can provide a microstructure that has large density and shock impedance differences over length scales of 10-100 microns, resulting in enhanced materials fragmentation in the shock or brisant loading regime, incipient melting at the lower melting point constituents, and additional enhancement of fragmentation in the gas-dynamic expansion phase of munitions breakup. Additionally, the present inventions provide a range of surface and near-surface processing methods to enhance spall and ejecta from conventional munitions systems, enhancing munition breakup and reactivity as well.

Example Processing Embodiment. The present invention can provide a method of mixing high reactivity and high density materials to create a material with a unique microstructure that has very high density and shock impedance differences on length scales of 10-100 microns. The method can involve the use of thixotropic (also called semi-solid) alloy processing. The method can involve conventional liquid metal casting but with a dispersion of immiscible high density phases and the use of electromagnetic stirring to agitate the melt and maintain a uniform distribution of said high density particles. The method can involve the creation of powder metallurgical compacts of energetic materials and high density materials, and them using controlled melt and electromagnetic stirring the creation of said microstructure with a uniform distribution of high density particles in a lower density, reactive material matrix.

Example Processing Embodiment. The present invention can provide a method of creating a reactive material that has high density and/or thermo-physical properties gradients on a length scale of 10-100 microns. The method can create a material that will exhibit incipient melting under initial shock loading, and thereby experience enhanced material breakup on subsequent gas dynamic expansion. The method can involve the use of thixotropic (also called semi-solid) alloy processing. The method can involve conventional liquid metal casting but with a dispersion of immiscible high density phases and the use of electromagnetic stirring to agitate the melt and maintain a uniform distribution of said high density particles. The method can involve the creation of powder metallurgical compacts of energetic materials and high density materials, and them using controlled melt and electromagnetic stirring the creation of said microstructure with a uniform distribution of high density particles in a lower density, reactive material matrix.

Figure 2:
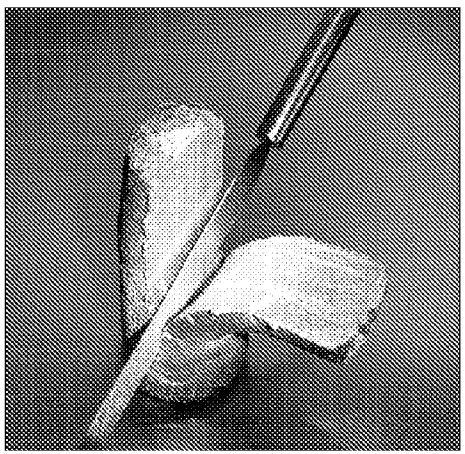
FIG. 2 is an illustration of a metal in a semi-solid state.

Example Processing Embodiment. Semisolid metal (SSM) processing is a hybrid technology that allows stirring of alloys during solidification to lead to a change in the solidifying microstructure resulting not only in a dramatic lowering of the apparent viscosity of the semisolid slurry (thixotropy), but also facilitating two-phase homogeneous flow at high fractions solid. The example embodiment adds 30%-40% vol. of tantalum or tungsten to enhance the density, accentuate the shock impedance mismatch, and enhance material breakup on case expansion. These high density additions can be in powder form and can first be part of a cold-pressed powder billet that can then be heated and thixotropically stirred to create high density SSM, or HD-SSM. The ease of deformation and processing of these materials is illustrated in FIG. 2, where a biller heated to the right processing temperatures can be literally cut with a butter knife.

Figure 3:
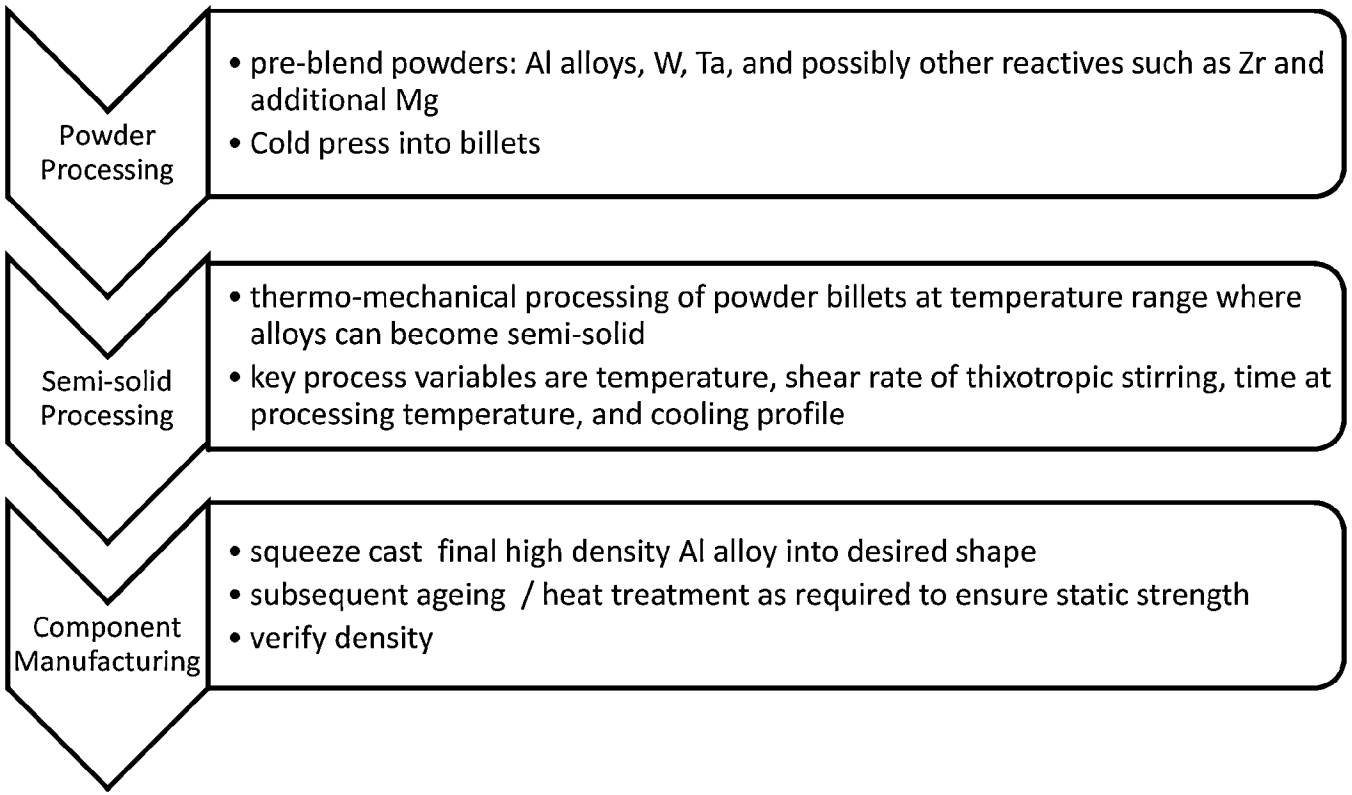
FIG. 3 is a schematic illustration of high level process flow relating to an example embodiment of the present invention.

FIG. 3 is a schematic illustration of high level process flow relating to an example embodiment of the present invention. In a first step, appropriate powders are blended and pressed into billets. Appropriate powders include Al alloys, W, Ta, and other reactives such as Zr and additional Mg. In a second step, the powder billets undergo thermo-mechanical processing at temperature range where alloys can become semi-solid. In this step, key process variables include temperature, shear rate of thixotropic stirring, time at processing temperature, and cooling profile. In a third step, the final high density Al alloy is squeeze cast into a desired shape. In necessary, the squeeze cast item can undergo subsequent ageing/heat treatment as required to ensure static strength. Properties such as density of the final item can be verified.

A specific example of processing according to the process of FIG. 3 can comprise the following steps:

1. Start with Aluminum alloy 357 base composition powders with a range of particle sizes, ranging from −100 mesh to −325 mesh depending on the amount and size of the higher density particle phase to be blended along with these powders.
2. Include 30-40 volume percent of commercially pure Tantalum powders at a −325 mesh particle size.
3. Cold press into a powder pre-form billet using either die pressing of powders into a closed die, or using cold isostatic pressing (CIP).
4. Place powder pre-form billet into an induction heated crucible as part of the semi-solid processing equipment.
5. Heat to between 500 C and 600C to get some liquid phase from the aluminum, and subject to electromagnetic stirring of powder preform billet.
6. Continue to stir in the semi-solid temperature range and thereby form the semi-solid microstructure in the presence of the high density particle phase.
7. Cool so that the partial liquid phase solidifies.
8. This phase will be mostly aluminum—silicon eutectic.
9. The solid high density particles will be pargely immiscible and will migrate to the regions of terminal eutectic in between the spherodized alpha aluminum particles that result from the semi-solid processing.

Figure 4:
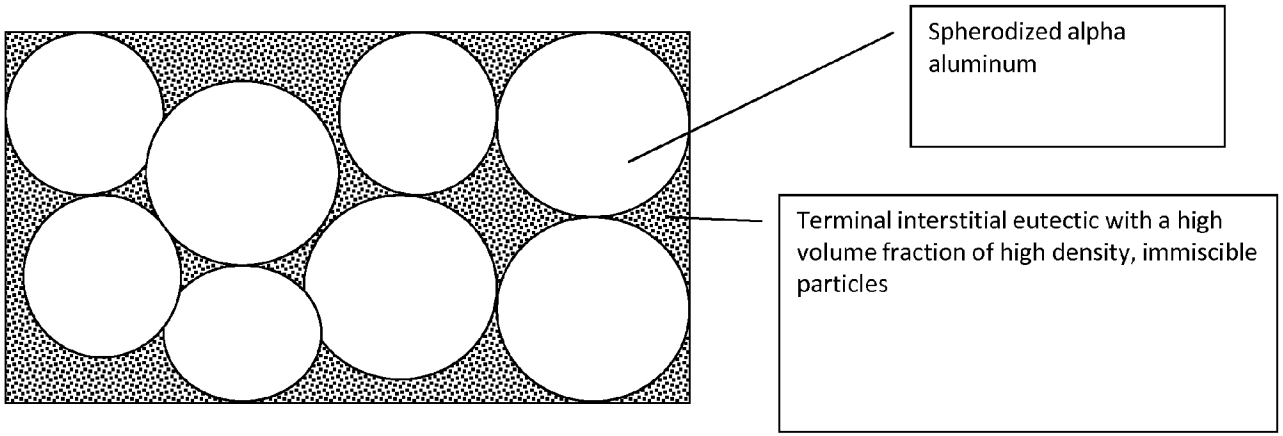
FIG. 4 is a schematic illustration of a material produced according to an embodiment of the present invention.

FIG. 4 is a schematic illustration of a material made according to the example process. The material comprises spherodized alpha aluminum with a terminal interstitial eutectic with a high volume fraction of high density, immiscible particles.

Example Embodiment. The present invention can provide items with surfaces having features such as cones in the surface of the item. Such features can result in small, shaped jets of material from the surface what can distribute the ejecta and reactive material throughout the reaction zone at very high speeds. The ejecta particles can travel over 2 times faster than the case and their size is proportional to the size and spacing of the pattern manufactured into the case surface, thereby overcoming classical Gurney Equation velocity limitations on high explosive driven metal systems.

The present invention can provide items having void arrays in a thin layer between an explosive and an outer case, as illustrated schematically in FIG. 1. The void arrays can be patterned. The void arrays can produce a patterned array of droplets rather than a uniform case expansion. This "hyperbolic lithography" can be used to control and pattern the breakup of the case wall. Preferably, the voids are not exposed at the interface between the high explosive and the metal, which can cause increased sensitization of the munition and the potential for pre-mature material detonation. To avoid this effect, the patterned void array can be just slightly below the metal surface that is in contact with the high explosive charge.

Figure 5:
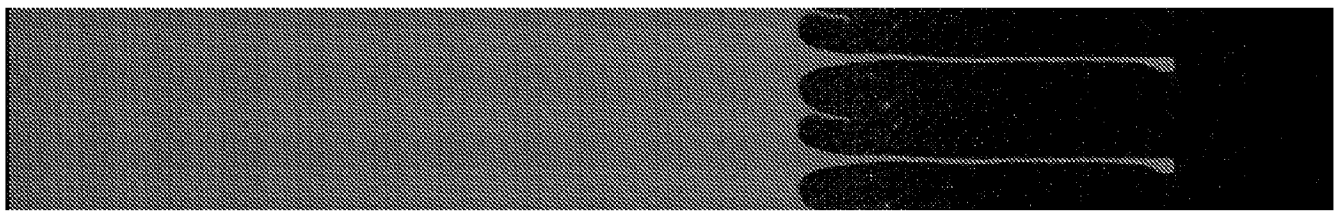
FIG. 5 is an x-ray image of metal jets ejected from a copper surface prepared according to an embodiment of the present invention.

In a high density aluminum SSM, there will be large shock impedance mismatches on the length scale of 10-100 microns. Also, as the shock passes through these regions and pressures and locally elevated, there can be incipient melting to cause wholesale material disintegration. Texturing of the surface of the item can enhance spall and ejecta. These ejecta can travel up to two times the surface velocity of the case, thereby overcoming limitations imposed by the Gurney equation for maximum metal velocity in a HE-driven metal system. The surface features such as cones or troughs will "invert" during shock loading, and metal jets will come off of these features. An x-ray image of such metal jets coming off the surface of copper is shown in FIG. 5.

Figure 6:
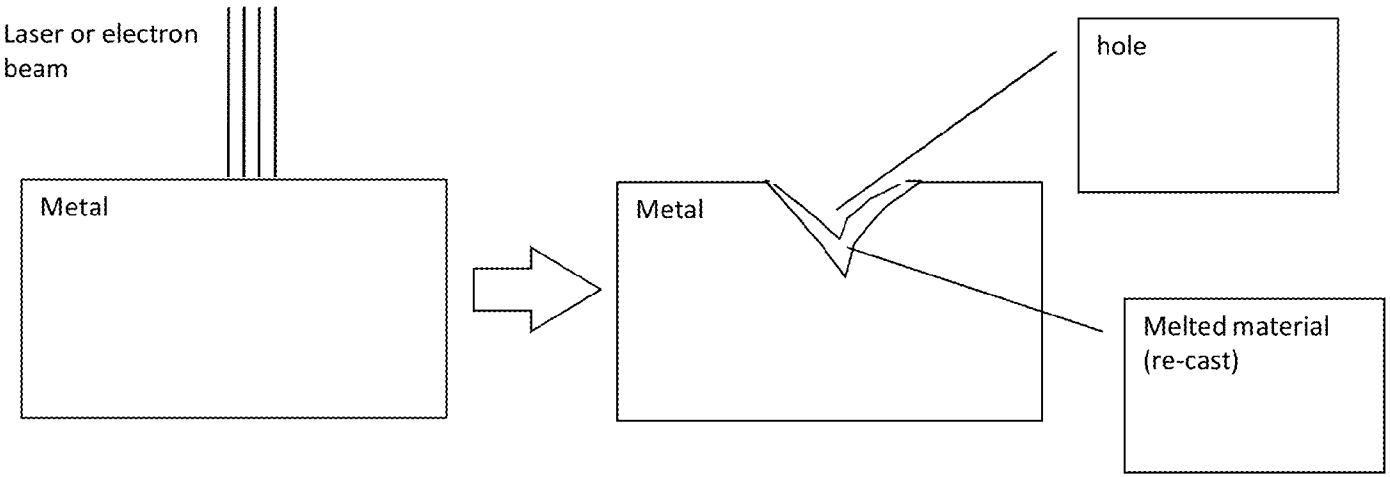
FIG. 6 is a schematic of an electron beam drilled or laser beam drilled partial penetration hole.

Suitable surface features can be created by, as examples, laser surface drilling or texturing; and by electron beam surface drilling or texturing. A schematic of an electron beam drilled or laser beam drilled partial penetration hole is shown in FIG. 6. In this case, it is a cone-shaped feature that under shock loading will invert to form metal jets like that described above.

The present inventions can provide reactive material with high stored enthalpy in several ways. For example, aluminum alloys have a high heat of combustion, relatively fewer grams of O2 consumed per gram of fuel, a moderate ignition temperature, and a good reaction efficiency parameter. As another example, the use of semi-solid process materials introduces extreme microstructural heterogeneity and offers lower melting point constituents, which can enhance material breakup and ease ignition start. As another example, augmentation of aluminum alloy system with dispersed powders and oxidizer, e.g. Zr powders with lower fire start temperatures, can further facilitate ignition.

The present inventions can provide shock-driven bulk and surface material breakup, which can also respond to gas-dynamic breakup as well as promote a desirable particle size distribution. As an example, Al semi-solid processed alloys have large material heterogeneity over a length scale of 10-100 microns. The heavy metal additions can tend to segregate to the terminal Al—Si eutectic between the [illegible]-Al globular clusters, thereby exacerbating the shock impedance difference and promoting breakup. As another example, the interparticle Al—Si eutectic is lower melting point than the bulk Al particles, thereby improving chances of shock-induced liquation and enhanced ejecta. As another example, surface texturing can enhance surface ejecta and can be used on the outer case to create a stream of fine Al particles that can move as fast a twice the metal free surface velocity. As another example, patterned voids near the HE/metal interface can further enhance the metal breakup performance.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

We claim:

1. A method of producing a material, comprising mixing high reactivity and high density materials such that the resulting material has a microstructure with high density and shock impedance differences on length scales of about 10-100 microns.

2. A method as in claim 1, further comprising ageing, heat treating, or a combination thereof, of the material.

3. A method of producing a material, comprising mixing high reactivity and high density materials such that the resulting material has thermo-physical gradients on a length scale of about 10-100 microns.

4. A material produced according to the method of claim 1.

5. A material produced according to the method of claim 3.

6. A method as in claim 3, further comprising ageing, heat treating, or a combination thereof, of the material.

7. A material, comprising spherodized alpha aluminum and terminal interstitial eutectic with a high volume fraction of high density, immiscible particles, produced by (a) thixotropic processing of two or more of Al alloys, W, Ta, Zr and Mg; and (b) forming the processed material into a final or near-final shape.

* * * * *